United States Patent [19]

Zanetta et al.

[11] Patent Number: 4,771,993

[45] Date of Patent: Sep. 20, 1988

[54] DEVICE FOR INJECTING DIVIDED SOLID MATERIALS IN A SMELTING BLAST FURNACE

[75] Inventors: Hugues Zanetta, Saint-Julien-les-Metz; Yann de Lassat de Pressigny, Metz; Michel Schneider, Senecourt, all of France

[73] Assignee: Institut de Recherches de la Siderurgie Francaise-IRSID, Maizieres-les-Metz, France

[21] Appl. No.: 858,927

[22] Filed: May 2, 1986

[30] Foreign Application Priority Data

May 6, 1985 [FR] France ..... 85 06849

[51] Int. Cl.[4] ..... C21B 7/16

[52] U.S. Cl. ..... 266/267; 75/10.19

[58] Field of Search ..... 266/182, 219, 47, 186, 266/218, 265–270; 373/18–25; 219/121 PP; 75/41, 42, 10.19, 10.20, 10.21, 10.22

[56] References Cited

U.S. PATENT DOCUMENTS

| | | | |
|---|---|---|---|
| 3,827,851 | 8/1974 | Walker . | |
| 3,892,882 | 7/1975 | Guest et al. | 219/121 PP |
| 4,002,466 | 1/1977 | MacRae et al. | 75/10.22 |
| 4,072,502 | 2/1978 | Santen et al. | 75/42 |
| 4,422,624 | 12/1983 | Dunham et al. . | |
| 4,611,332 | 9/1986 | Santen | 75/10.22 |

FOREIGN PATENT DOCUMENTS

| | | | |
|---|---|---|---|
| 0152389 | 8/1985 | European Pat. Off. . | |
| 2530666 | 1/1984 | France . | |
| 393554 | 4/1964 | Japan | 266/218 |
| 423846 | 9/1974 | U.S.S.R. | 266/186 |
| 2085575 | 4/1982 | United Kingdom . | |

*Primary Examiner*—Melvyn J. Andrews
*Attorney, Agent, or Firm*—Staas & Halsey

[57] ABSTRACT

The tuyere comprises a substantially cylindrical or slightly convergent frusto-conical downstream part, and a divergent frusto-conical upstream part; the plasma torch is placed co-axially to the tuyere at the inlet to the upstream part thereof; the solid materials injection nozzle issues at an angle into the upstream part of the tuyere and the angle of taper of the upstream part of the tuyere substantially corresponds to the angle of natural expansion of the plasma jet, so that said materials are carried with the plasma jet and that part of them are provided onto the inner wall of the tuyere.

6 Claims, 1 Drawing Sheet

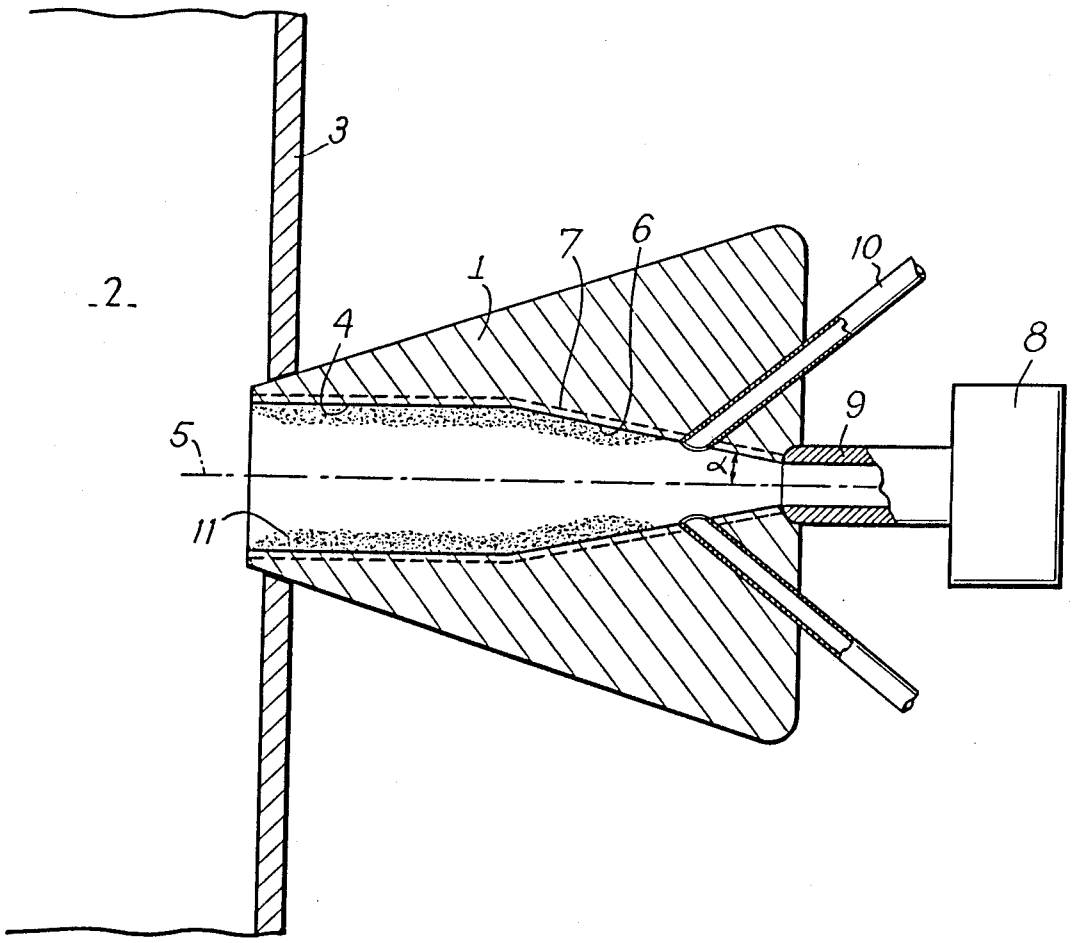
8
10
9
α
6
7
1
3
4
5
11
2

DEVICE FOR INJECTING DIVIDED SOLID MATERIALS IN A SMELTING BLAST FURNACE

The present invention relates to the injection of divided solid materials, preferably in pulverized form, in a furnace such as a blast furnace.

More particularly, in the case of smelting blast furnaces the injected materials may be metallic oxides, such as iron ore, and injected through a special tuyere directly into the high temperature reaction zone of the blast furnace.

Although the invention may, in other applications, be used for injecting for example, powdered coal in combustion furnaces, reference is made hereafter for clarity's sake, to the case of the injection of materials in a blast furnace for producing smelt.

Conventionally, such injections are cooling adjunctions of which the effect should be compensated by heat advantageously supplied by a plasma-arc electric torch.

An injection device of this type is known in particular from document FR-A-2 512 313. Regrettably, this document describes only very diagrammatically the device, and does not dwell on the difficulties met with in the manufacture of the tuyere which is required to withstand very high temperatures and very severe abrasive conditions.

It is the object of the present invention to propose a simple and strong injection device with which it is effectively possible to inject divided solid materials under high temperatures supplied by plasma torches.

This object is reached, according to the invention, with a device comprising a plasma torch, a tuyere extending the torch and at least one nozzle for injecting the solid materials downstream of the torch; said tuyere comprises a substantially cylindrical or slightly convergent frusto-conical downstream part, and a divergent frusto-conical upstream part; the plasma torch is placed co-axially to the tuyere at the inlet to the upstream part thereof; the solid materials injection nozzle issues at an angle into the upstream part of the tuyere and the angle of taper of the upstream part of the tuyere substantially corresponds to the angle of natural expansion of the plasma jet, so that said materials are carried with the plasma jet and that part of them are projected onto the inner wall of the tuyere.

A self-lining of the inner wall of the tuyere is thus obtained, which, on the one hand, limits heat losses, and on the other hand, protects the tuyere against abrasion and high temperatures.

Moreover, the lining layer automatically finds a stabilizing thickness.

The self-lining effect is helped if the materials are injected in powdered form.

It is possible to shape the inner wall of the tuyere in such a way that the projected materials attach more readily thereon.

The invention will be more readily understood on reading the following description, with reference to the accompanying FIGURE which shows a cross-section of the device according to the invention.

As can be seen on the FIGURE, the tuyere 1 issues into the reaction zone 2 of a blast furnace, of which only the stack casing 3 is shown. The tuyere 1 comprises, on the inside, a substantially cylindrical downstream part 4, of axis 5, preceded by a divergent frusto-conical upstream part 6 of same axis 5. The inner passage of the tuyere is cooled by conventional means (such as a water flow, for example) which are symbolized by dotted lines 7.

A plasma torch 8 is provided in axial extension of the tuyere 1, its downstream electrode 9 abutting spherically against the back of the tuyere 1, in such a way that the plasma jet issues directly into the conical part 6 of the tuyere. The taper of the latter is substantially equal to the angle of natural expansion of the plasma jet (normally 11°). Were it slightly less than that, the peripheral speeds of the jet of plasma would be too high to achieve the required object. If, on the contrary, it were substantially higher, a recirculation zone would form around the jet of plasma, which could—by depression—entail the penetration into the tuyere of the smelting coming from the blast furnace.

Injection nozzles 10 issue at an angle in the conical part 6 of the tuyere and are connected to a supply source supplying pulverulent materials (such as iron oxides for example) and a carrier gas. The injected pulverulent material meets up with the jet of plasma in a zone of very high temperatures, over 4000° C.

The pulverulent material then passes to the liquid state, and the main part is carried away by the plasma jet into the reaction zone of the blast furnace. But due to the design of the device according to the invention, part of the material tends to deposit on the cooled inner wall of the tuyere, especially as this phenomenon is helped by the whirling effect of the plasma jet (existence of a vortex). A layer 11 is then created on the inner wall of the tuyere 1, the thickness of which layer is self-regulated: the excess materials melt and tend to be carried away by the injected jet. To enable the injected material to come back on the wall, it is important that said material does not penetrate too far into the plasma jet, and therefore that the outlets of the injection nozzles are just flush with the frusto-conical wall, as in the illustrated example.

Self-lining of the inner wall of the tuyere may be helped by providing said tuyere with an adhesion zone: for example by providing refractory inserts thereon. For the same reason, it is possible to arrange for the downstream part 4 of the tuyere to have a slightly convergent frusto-conical shape.

The downstream and upstream parts, 4 and 6 respectively, may be produced in one piece or in a plurality of pieces.

Obviously the invention is not limited to the example described hereinabove and can also be applied to the injection of finely divided solid materials of any nature (metallic oxide, carbon-containing material such as coal, coke, etc.) or form (dry or wet dusts, or pulp, such as for example an aqueous ore-water or coal-water pulp, etc . . . ). It is also possible to build injection nozzles that sink in when new. Then, rapidly, with wear and melting with the plasma, said nozzles will come to be level with the frusto-conical wall and thus reach the object of the invention.

What is claimed is:

1. A device for injecting finely divided solid materials into a furnace, comprising:

(a) a tuyere for injecting therethrough the materials into the furnace, said tuyere having a bore extending therethrough, said bore being composed of successive continuous coaxial first and second bore portions joined at a point at which the first and second bore portions are the same size, the first bore portion being distant from the furnace and having an inlet, and the second bore portion issuing in the furnace, the first bore portion being divergent frusto-conical with a predetermined angle of taper becoming larger toward the furnace, the second bore portion being substantially cylindrical;

(b) at least one nozzle issuing at a second predetermined angle into said first bore portion of said tuyere for injecting the materials therein;

(c) a plasma torch located coaxially to said tuyere at said inlet of the first bore portion for issuing into said bore a plasma jet having a predetermined angle of natural expansion, wherein said predetermined angle of taper of said first bore portion is substantially equal to said predetermined angle of natural expansion of said plasma jet, so that the materials injected by said at least one nozzle are carried with said plasma jet and partially projected onto a peripheral wall of said bore.

2. A device for injecting finely divided solid materials into a furnace according to claim 1, wherein said peripheral wall is provided with an adhesion zone for promoting depositing thereon of the projected materials.

3. A device for injecting finely divided solid materials into a furnace according to claim 1, further comprising a cooling system for cooling said peripheral wall of said tuyere.

4. A device for injecting finely divided solid materials into a furnace, comprising:

(a) a tuyere for injecting therethrough the materials into the furnace, said tuyere having a bore extending therethrough, said bore being composed of successive continuous coaxial first and second bore portions joined at a point at which the first and second bore portions are the same size, the first bore portion being distant from the furnace and having an inlet, and the second bore portion issuing in the furnace, the first bore portion being divergent frusto-conical with a predetermined angle of taper, becoming large in size toward the furnace, the second bore portion being slightly convergent toward the furnace;

(b) at least one nozzle issuing a second predetermined angle into the first bore portion of said tuyere for injecting the materials therein;

(c) a plasma torch located coaxially to said tuyere at said inlet of the first bore portion for issuing into said bore a plasma jet having a predetermined angle of natural expansion, said predetermined angle of taper of the first bore portion being substantially equal to said predetermined angle of natural expansion of said plasma jet, so that the materials injected by said at least one nozzle are carried with said plasma jet and partially projected onto a peripheral wall of said bore.

5. A device for injecting finely divided solid materials into a furnace according to claim 4, wherein said peripheral wall is provided with an adhesion zone for promoting depositing thereon of the projected materials.

6. A device for injecting finely divided solid materials into a furnace according to claim 4, further comprising a cooling system for cooling said peripheral wall of said tuyere.

* * * * *